United States Patent [19]

Warren

[11] 4,094,441

[45] June 13, 1978

[54] STAMP DISPENSING APPARATUS

[76] Inventor: Daniel Davis Warren, 7317 Fisher Rd., Dallas, Tex. 75214

[21] Appl. No.: 737,464

[22] Filed: Nov. 1, 1976

[51] Int. Cl.[2] ..... B65H 7/18

[52] U.S. Cl. ..... 221/18; 214/1 BT; 221/211; 271/30 A

[58] Field of Search ..... 221/17-20, 221/93, 211, 232, 279; 194/93, DIG. 8, DIG. 20; 214/1 BT; 271/30 R, 30 A, 102, 104, 149, 150, 160

[56] References Cited

U.S. PATENT DOCUMENTS

| | | | |
|---|---|---|---|
| 1,014,278 | 1/1912 | Zaerr et al. | 194/DIG. 20 X |
| 1,091,824 | 3/1914 | Fox | 194/DIG. 20 X |
| 2,546,352 | 3/1951 | Weaver | 221/17 |
| 2,836,328 | 5/1958 | Kinney | 221/211 |
| 2,840,270 | 6/1958 | Gore | 221/211 |
| 3,108,714 | 10/1963 | O'Brien | 221/211 |
| 3,200,925 | 8/1965 | Swaney | 221/17 X |
| 3,298,566 | 1/1967 | Wartell | 221/19 |
| 3,342,372 | 9/1967 | Whitchurch | 221/211 X |
| 3,410,383 | 11/1968 | DeFex | 194/93 X |
| 3,767,083 | 10/1973 | Webb | 221/279 |

FOREIGN PATENT DOCUMENTS

| | | | |
|---|---|---|---|
| 1,427,168 | 12/1965 | France | 221/211 |

*Primary Examiner*—Robert B. Reeves
*Assistant Examiner*—Fred A. Silverberg
*Attorney, Agent, or Firm*—Fulbright & Jaworski

[57] ABSTRACT

Apparatus for dispensing stamps having a housing including therein magazine means for containing and positioning stamps, suction means for releasably attaching to and withdrawing a stamp from the magazine means, means for actuating the suction means, means for releasing a stamp from the suction means and chute means for receiving the stamp upon release thereof from the suction means.

10 Claims, 7 Drawing Figures

Fig. 1
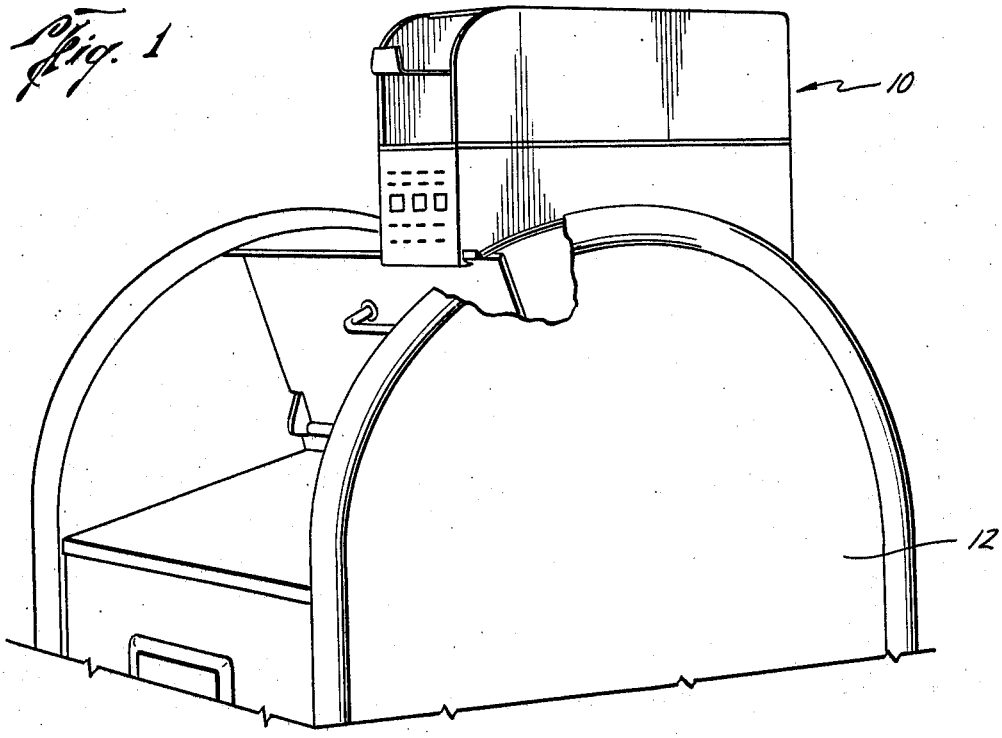
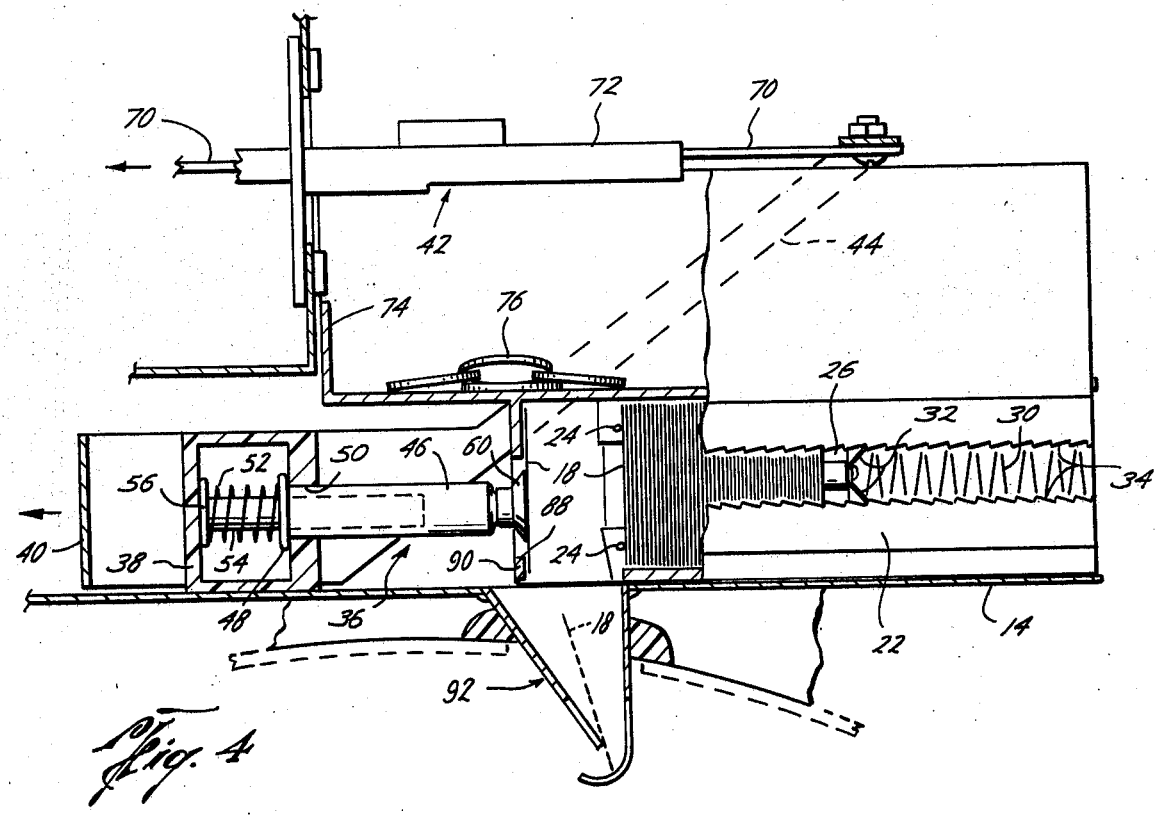
Fig. 4

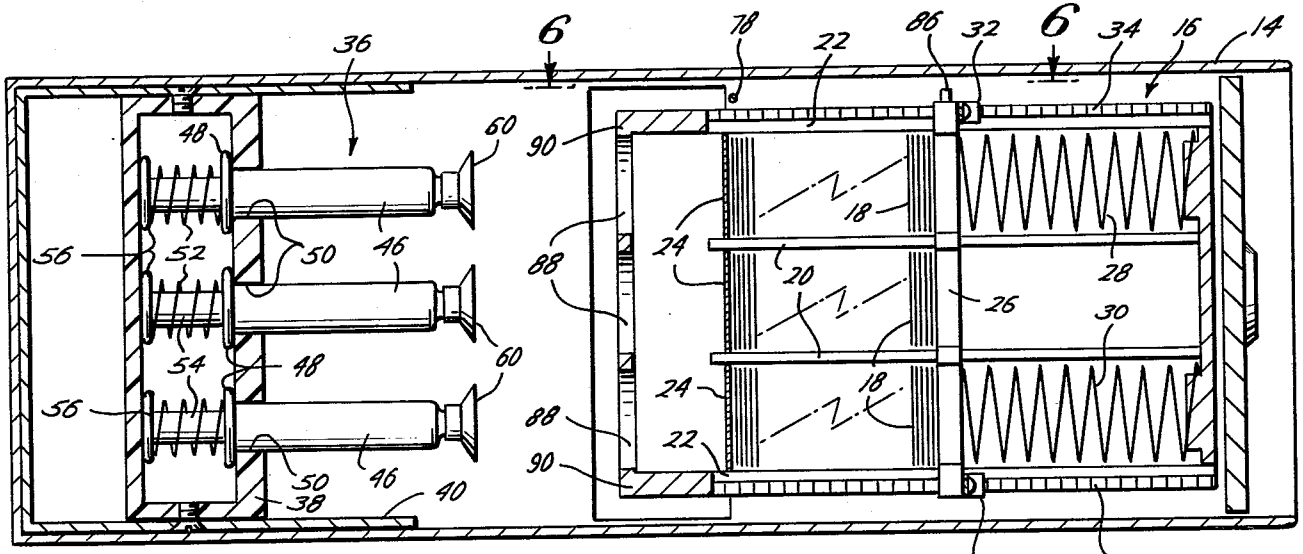
Fig. 5
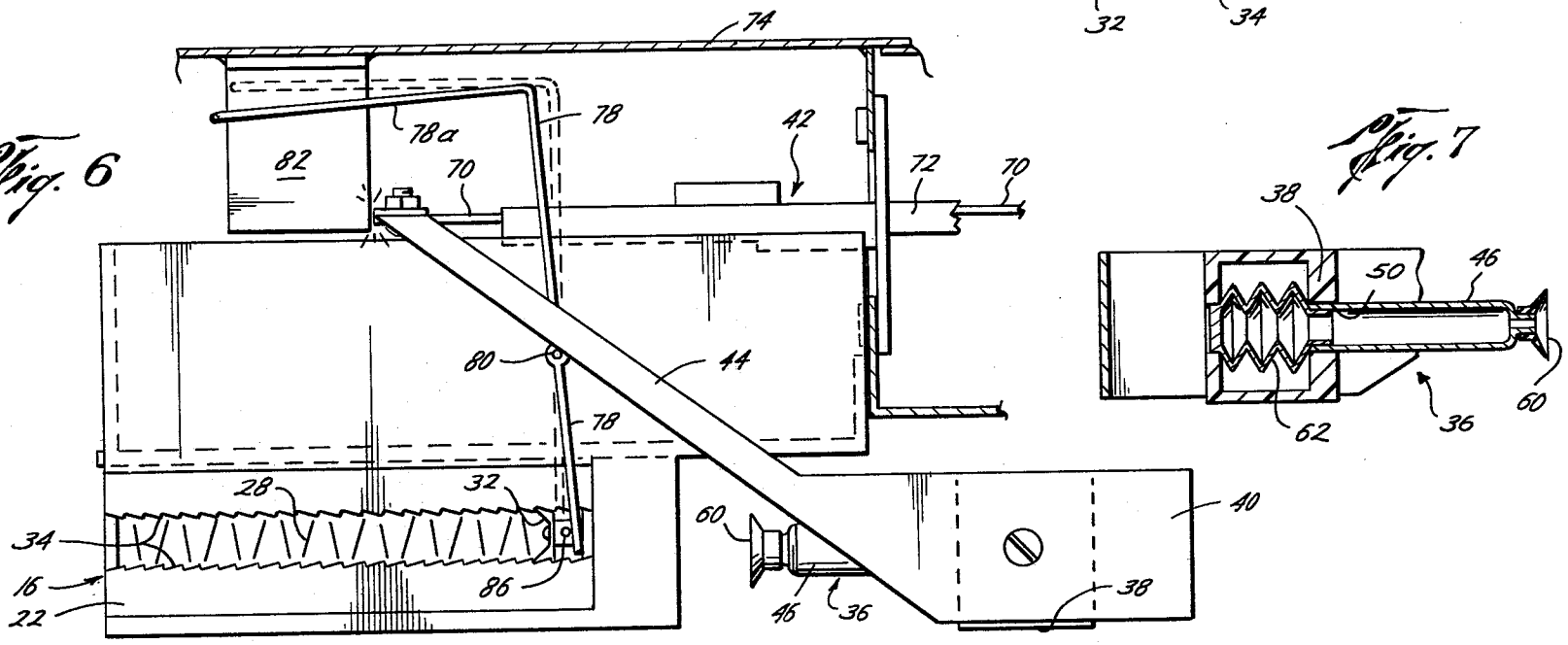
Fig. 6
Fig. 7

STAMP DISPENSING APPARATUS

BACKGROUND OF THE INVENTION

Postage stamps typically are made available to the public by window sales at post offices, by vending machines at small postal stations and by countertop vending machines in stores. Limitations of each of these vending methods inconvenience the purchasing public inasmuch as long lines and limited hours restrict both the sale and purchase of stamps at post offices and to an extent in stores while postal stations are few and far between. Moreover, the end result of the purchase of postage is the deposition of stamped mail in a post office or mailbox.

Because there probably are hundreds of thousands of mailboxes into which stamped mail is deposited for collection by the postal service, it would be eminently convenient for the postage-buying public to purchase stamps at each mailbox location. Countertop type vending machines obviously are not suited for the vending of stamps at mailboxes because of lack of protection against the weather, theft, pilferage and the like. The larger vending machines typically located at postal stations likewise are not suited for use at mailbox locations owing to bulkiness, expense and vulnerability to climatic conditions.

It is apparent that utility, convenience, ready accessibility of postage and other advantages would accompany apparatus for vending postage stamps at the site of a mailbox whether the apparatus is secured to the box or to an adjoining structure. The present invention is directed to such an apparatus.

While countertop or wall-mounted vending machines as well as elaborate electro-mechanical stamp dispensing apparatus located at postal stations have existed for some time, applicant is unaware of prior art directly relevant to the present invention. Applicant is aware, however, of reciprocating suction apparatus for use in applying caps to containers and the like such as U.S. Pat. Nos. 2,836,328, 2,668,000 and 3,342,372. These patents do not relate to stamp dispensing devices.

SUMMARY OF THE PRESENT INVENTION

The present invention is directed to an apparatus for dispensing postal stamps in particular although it may be used as a dispenser for other goods of a configuration suited for dispensing in such apparatus. The apparatus generally includes a housing having a magazine for containing and positioning the stamps, a suction mechanism for releasably attaching to and withdrawing a stamp or stamps from the magazine, an actuator such as a coin slide means for manipulating the suction means to withdraw a stamp from the magazine, means for releasing the stamp from the suction means and a chute for receiving the stamp upon release thereof from the suction means. Preferably, the apparatus includes means to prevent actuation of the actuating means upon insertion of a coin in the apparatus when stamps in the magazine are exhausted. Also, the preferred form of stamps for dispensing in apparatus of the present invention is an adhesive, pressure-sensitive stamp with a removable backing. As compared with stamps of the mucilage type, pressure-sensitive stamps do not adhere to one another under high humidity conditions.

Advantageously, the magazine means of the dispensing apparatus of the present invention may be constructed to include one or a plurality of rows of stacks of stamps to provide versatility in the vending of different stamp denominations and combinations of denominations keyed to the types of coins that are inserted therein. Concomitantly, a plurality of suction means may be provided corresponding to the number of rows of stacks of stamps within the magazine, all as will be described hereafter with respect to the preferred embodiments of the invention.

It is, therefore, an object of the present invention to provide apparatus for dispensing postage stamps and the like, the apparatus being adapted for exterior or outdoor climatic conditions and suitable for location and installation on or in proximity to mailboxes or mail receptacles.

Still a further object of the present invention is the provision of such an apparatus having magazine means for containing and positioning the stamps, suction means for withdrawing a stamp or stamps from the magazine means, means for actuating the suction means, means for releasing a stamp from the suction means, and means for receiving and delivering a stamp upon release thereof from the suction means.

A further object of the present invention is the provision of a stamp dispensing apparatus as heretofore described wherein the means for actuating the suction means is coin operated.

A still further object of the present invention is the provision of such an apparatus wherein means are provided to prevent actuation thereof upon insertion of a coin in the apparatus when stamps in the magazine means are exhausted.

Yet another object of the present invention is the provision of such an apparatus wherein a plurality of rows of stacks of stamps may be dispensed.

Still another object of the present invention is the provision of such an apparatus wherein the magazine means includes pawl and cog means to provide unidirection movements of stamps in the magazine means for coaction with the suction means.

Another object of the present invention is the provision of suction means for a stamp dispensing apparatus as heretofore described wherein said suction means comprises a tube and support coacting with the actuating means together with either a slideable plunger or a bellows to provide suction for attachment of a stamp in the magazine means to the tube.

Still other and further objects, features and advantages will be apparent from the following description of a presently preferred embodiment of the invention, given for the purpose of disclosure and taken in conjunction with the accompanying drawings.

BRIEF DESCRIPTION OF THE DRAWINGS

In the drawings forming a part of the disclosure herein, like character references designate like parts throughout the several views, wherein FIG. 1 is a perspective view of the dispensing apparatus of the present invention mounted on and secured to a conventional mailbox or mail receptacle, FIG. 4 is a partial, cut-away side elevational view, partly in cross section, illustrating the positioning of the suction means and stamp secured by suction thereto whereby the stamp is about to be released from the suction means, FIG. 5 is a partial plan view, partly in cross section, taken along the line 5—5 of FIG. 2 and illustrating the suction means and magazine means of the present invention, FIG. 6 is a partial cross-sectional elevational view of the present invention taken along the line 6—6 of FIG. 5 and illustrating means for preventing actuation of the present apparatus when stamps in the magazine means are exhausted, FIG. 7 is a partial cross-sectional view of bellows means forming one embodiment of the suction means of the present invention.

DESCRIPTION OF THE PREFERRED EMBODIMENTS

With reference to FIG. 1 of the drawings, the stamp dispensing apparatus 10 of the present invention is illustrated as being attached to a conventional mailbox or postal receptacle 12 in a manner as will be explained with reference to other figures of the drawings hereafter. The dispensing apparatus 10 may be mounted in any appropriate manner to the mailbox 12 or to any other structure that preferably is conveniently close to the mailbox. Also, it is preferred that the dispensing apparatus 10 be weatherproof, that is constructed in such a way that moisture will not affect the operation thereof in view of the desirability of outdoor location.

Figure 2:
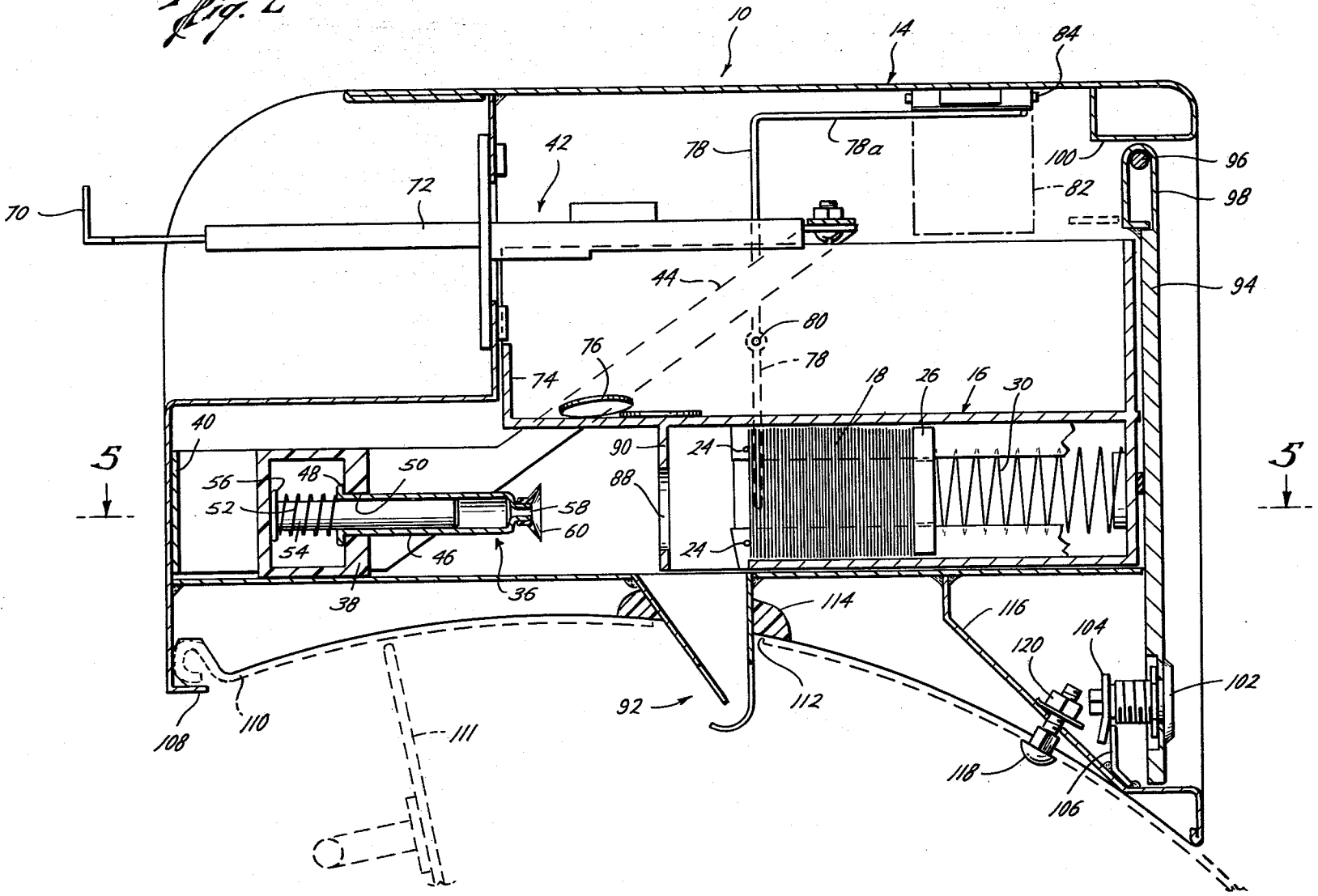
FIG. 2 is a cut-away side elevational view, partly in cross section, illustrating the dispensing apparatus attached to a mailbox, and showing the suction means at rest before being actuated.

Referring now to FIG. 2, the dispensing apparatus 10 includes a housing 14 that may be constructed of steel, heavy plastic or other appropriate waterproof and sturdy material. While the housing is illustrated as being of a generally rectangular configuration, it will be understood that it may take any shape depending on both aesthetic and practical considerations of mounting and the like. Also, it will be understood that appropriate seals may be included within the housing as necessary to effect weatherproofing of the device. Generally speaking, it will be understood that the housing encloses the operative elements of the apparatus, the various elements as hereafter explained being suitably mounted within or secured to the interior of the housing.

Figure 3:
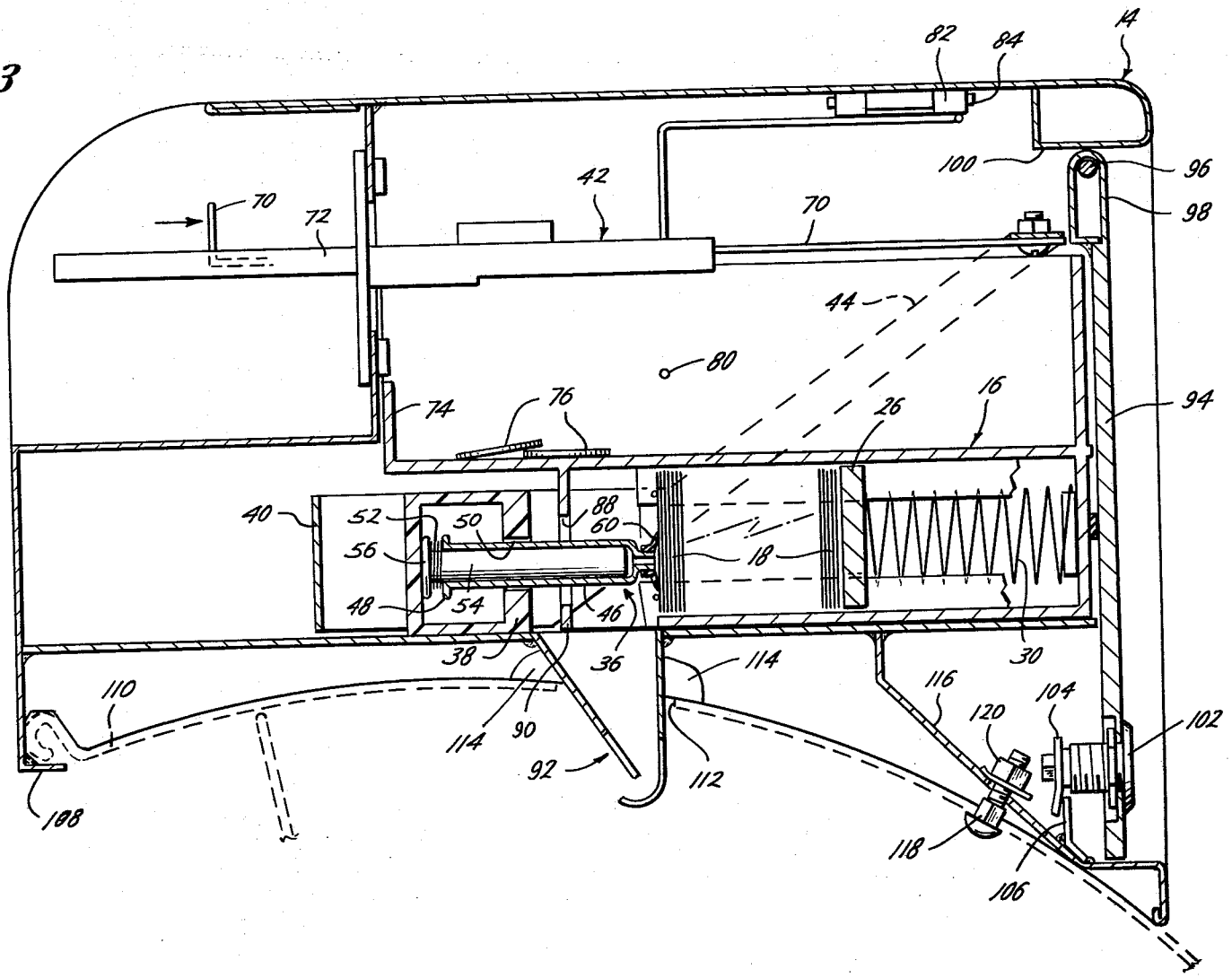
FIG. 3 is a view similar to that of FIG. 2 showing the suction means upon being actuated for suction engagement with the stamps in the magazine.

As illustrated in FIGS. 2, 3 and 5, a magazine means 16 is provided for containing and positioning stamps 18. As shown particularly in FIG. 5, the magazine may be constructed so as to accommodate a plurality of rows of stacks of stamps 18 depending on the vendor's desires, the denomination of stamps to be dispensed and the denomination of coins functioning to operate the apparatus of the present invention. The magazine 16 includes dividers 20 between rows of stamps and outer guides 22, all of which position and orient the stamps as shown. At the front of the magazine are pins or clips 24 that support one end of each row of stamps and function as yieldable retention means for retaining stamps in the magazine, being yieldable so as to release a stamp therefrom upon attachment of suction means to the stamp as will be explained hereafter. In other words, as shown in FIG. 2, a stamp 18 in a position adjacent the pins 24 may be pulled between the pins inasmuch as the pins 24 are parallel and are spaced to allow passage of the stamp therebetween.

With continued reference particularly to FIGS. 2 and 5, a pusher bar 26 supports each row of stamps 18 from behind, the bar 26 being maintained against the stamps and urged thereagainst by springs 28 and 30 acting against the housing 14. The pusher plate 26 is slideable within the magazine 16, the sliding action being controlled by pawl and cog means such that there is unidirectional movement of stamps in the magazine toward the suction means (described hereafter), that is toward the pins 24. The pawl and cog means are illustrated in FIGS. 4–6 and include pawls 32 secured such as by screws to the pusher plate 26 in a manner so that the pawls engage cogs 34 formed on parallel rails on both sides of the magazine 16. Preferably, the pawls 32 and cogs 34 are double acting (i.e. in duplicate) as illustrated in FIGS. 4 and 6 to promote stability of operation although it will be appreciated that single acting pawls and cogs may be used.

Referring once again to FIGS. 2 and 5, a suction means 36 is provided for releasably attaching to a stamp or stamps 18 in the magazine 16 so as to withdraw the stamp from the magazine. The suction means 36 as illustrated in FIGS. 2 and 5 includes a support member 38 secured such as by bolting to a carriage 40 that is slideable within the housing 14. The support 38 followably coacts with an actuating means 42 (as shown in FIG. 2) via an arm 44 attached at one end to the actuating means 42 and at the other to the support 38. Thus, sliding movement of the actuating means 42 in turn causes the support 38 and the carriage 40 to slide within the housing.

With continued reference to FIGS. 2 and 5, and the particular embodiment of suction means 36 illustrated therein, a tube 46 (a plurality of which are illustrated in FIG. 5) is retained within the support 38 by means of a flange 48 at one end thereof. The tube 46 is slideable within an aperture 50 formed in the support 38, the sliding ability of the tube 46 being further illustrated in FIG. 3. The flange 48 of each tube 46 restricts sliding movement thereof in one direction, while the dimensions of the support 38 and space occupied by a spring 52 (a spring being provided for each of the suction means as illustrated in FIG. 5) dictate the limit of movement of each tube 46 in an opposed direction. A plunger 54 is slideable within each tube 46 or, stated another way, each tube 46 is slideable along and exteriorly of each plunger 54. Each plunger 54 is provided with a flange 56 at one end against which the spring 52 acts while the opposed end of each plunger 54 moves within a tube 46. At the end of each tube 46 remote from the support 38 (as best shown in FIG. 2) is provided an aperture 58 whereby the tube 46 may take suction engagement with a stamp 18 in the magazine 16. The suction engagement is enhanced by the provision of a suction cup 60 fitted about the end of the tube 46. Thus, as shown in FIG. 2, the spring 52 biases the plunger 54 from the tube 46 and against the support 38 whereas as shown in FIG. 3, movement of the support 38 toward the magazine 16 and engagement of the suction cup 60 with a stamp 18 causes the plunger 54 to move into the tube 46. As the support 38 retreats from the magazine 16, movement of the plunger 54 out of the tube 46 creates a suction within the aperture 58 whereby a stamp will adhere to the suction cup 60, as shown, for example, in FIG. 4.

With reference to FIG. 7 of the drawings, another embodiment of the suction means 36 is illustrated wherein the plunger and spring have been replaced by a bellows 62 retained within the support 38, the tube 46 in such embodiment still being slideable within an aperture 50 in the support. The bellows 62 provides pneumatic communication with the tube 46 and also biases the tube 46 from the support 38 whereby the tube may make suction engagement with a stamp 18 in the same manner as previously described with respect to the spring-plunger embodiment.

With reference to FIGS. 2 and 3, the actuating means 42 actuates the suction means 36 whereby the suction means may releasably attach to and withdraw a stamp 18 from the magazine 16. The actuating means 42 preferably is coin operated, that is, may be fully operated only upon insertion of a coin in the actuator. The actuating means 42 may be of any suitable conventional type such as a coin friction slide, a coin being insertable in a slot within the lever 70 and the lever 70 being slideable within a housing 72 as illustrated in FIG. 3. Thus, unless a correct coin is inserted, the slide 70 will not fully slide within the member 72 whereas insertion of an appropriate coin therein allows the lever 70 to move into the position shown in FIG. 3. The latter movement causes the arm 44 to move the support 38 of the suction means 36 into suction engagement with a stamp 18 as best shown in FIG. 3. Because the actuator 42 may be comprised of any suitable conventional coin mechanism, no further description thereof is deemed necessary. However, it should be noted that walls within the housing 14 preferably form a coin box 74 to contain coins shown for illustrative purposes only and bearing the reference character 76.

Preferably, means are provided for preventing actuation of the actuating means 42 upon insertion of a coin in the apparatus of the present invention when stamps 18 in the magazine 16 are exhausted. As illustrated in FIGS. 2, 3 and 6, one embodiment of the means for preventing actuation of the actuating means 42 comprises an arm 78 pivotally secured within the housing 14 by means of a pin 80. An upper extension **78*a* of the arm is oriented adjacent a flap 82 likewise pivotally secured to the housing 14 by means of a pin 84. The lower end 78*b* (also shown in FIG. 5) is oriented adjacent one side of the magazine 16 so as to be contacted by a lug or bumper 86 secured to the pusher bar 26 of the magazine. Thus, as best shown in FIGS. 5 and 6, when the lug 86 of the pusher bar 26 contacts the lower end 78*b* of the arm 78, the arm 78 is moved from the dotted position to the position shown in FIG. 6 to release the flap 82 (from a retracted position as shown in FIG. 3 to an extended position as shown in FIG. 6). In the extended position, the flap 82 prevents the slide 70 of the actuator means 42 from moving to a fully actuated position and hence the suction means 36 may not make contact with stamps 18 in the magazine 16. Consequently, the person attempting to actuate the device of the present invention may withdraw the slide 70 from the position shown in FIG. 6 to the position shown in FIG. 2** and recover the coin inserted therein.

Means are provided for releasing a stamp 18 from the suction means 36. As shown in FIGS. 2–5, a preferred form of release means comprises a portal 88 within a wall 90 through which each tube 46 passes such that upon contact with the wall 90 by a stamp 18 in suction engagement with the tube 46, the stamp 18 is released from the tube. As shown in FIG. 5, a portal 88 is provided for each of the tubes 46. As best shown in FIG. 4, the stamp 18 is pulled from the tube 46 by means of the wall 90, the stamp or stamps then dropping gravitationally into a chute 92. Preferably, the chute 92 is slotted in order that the stamp or stamps therein may be removed by one's finger tips.

As shown in FIGS. 2 and 3, the housing 14 preferably is constructed so that access to the interior thereof is obtained by a door 94. The door swings about and is retained by a pin 96, the door having a tongue 98 that wraps around and engages the pin 96. By this construction, the door 94 may be lifted and, by sliding action relative to the pin 96, pushed inwardly such that the tongue 98 rests against a stop portion of the housing 100 to retain the door in a raised position. If desired, the housing 14 may be constructed such that the interior portions slide outwardly past the door 94 for ease of access as will be appreciated by those skilled in the art. When the door is in a closed position as shown in FIGS. 2 and 3, it may be locked by means of a conventional key lock 102 having a flange 104 that rotates upon actuation by a key to engage a lip 106 and thereby lock the housing.

As further shown in FIGS. 2 and 3, one method of mounting the housing 14 to a mailbox is to form the front portion of the housing 14 with a flange 108 that engages about the roof 110 of the mailbox. A hole 112 may be cut in the roof of the mailbox to receive the chute 92, the space between the hole and chute being sealed such as by means of rubber pieces 114. Then a rear plate 116 forming the part of the housing 14 may be attached such as by a bolt 118 to the roof 110 of the mailbox, resulting in a secure fit. Of course, the bolt 118 may have a smooth head to prevent its disengagement by other than removal of the nut 120 locked inside of the back cover 94 of the dispenser apparatus. Naturally, the dispenser apparatus of the present invention may be secured in any other suitable manner to either the mailbox or to other appropriate structure. However, by the mounting method described above, stamps dispensed and retained by the chute means 92 are accessible by opening the door 111 of the mailbox, this feature promoting the weather resistance of the entire apparatus.

In summary, the apparatus of the present invention is operated by first placing stamps 18 in the magazine 16 as shown in FIG. 5. As previously explained, the magazine 16 may be constructed to receive any number of rows of stacks of stamps as desired. Then the pusher plate 26 is pressed behind the stamps and by means of springs 28 and 30 is biased thereagainst. Thus the stamps are urged against the pins 24. The dispenser is then operated by inserting a coin in the slide 70 when the slide is in the position shown in FIG. 2. The slide 70 is then passed inward to the position shown in FIG. 3 at which point the coin 76 falls into the coin box 74. At the same time, the arm 44 attached to the slide 70 moves the suction means support 38 with respect to the housing 14 which in turn causes the tube 46 to move forward into a position as shown in FIG. 3. In the course of such movement, a vacuum is created within the tube 46 by relative movement of the tube 46 with respect to the plunger 54. The tube 46 is thus in suction engagement with the lead stamp 18 in the magazine 16, and the slide 70 is then pulled back (manually or by springs not shown) to its original position as shown in FIG. 2. In the course of the described movement and as shown in FIG. 4, the stamp 18 is released from the suction of the tube 46 by means of the wall 90 as the tube passes through the portal 88. The stamp 18 then drops into the chute 92 to be removed by the purchaser. Naturally, it will be understood that the foregoing description applies to each tube and suction means provided in the apparatus.

Once the supply of stamps 18 in the magazine 16 is exhausted, the lug 86 carried by the pusher bar 26 contacts the lower end 78*b* of the arm 78 whereupon the upper end 78*a* of the arm releases the flap 82 to restrict movement of the slide 70. Thus the apparatus of the present invention cannot be operated and the potential purchaser's coin is retrievable.

The present invention, therefore, is well adapted to carry out the objects and attain the ends and advantages mentioned as well as others therein. While a presently preferred embodiment of the invention has been given for the purpose of disclosure, numerous changes may be made without departing from the spirit and scope of the invention as hereinafter claimed.

What is claimed is:

1. Apparatus for dispensing stamps, having a housing including therein, (a) a magazine for containing and positioning at least one row of a stack of stamps, (b) suction means for releasably attaching to a stamp in said row and withdrawing said stamp from the magazine (a), said means comprising, (i) a support slideable within the housing, (ii) a tube slideably retained within the support (i), and (iii) means urging the tube (ii) away from the support (i) whereby said tube engages by suction the stamp within the magazine (a), (c) coin actuated means for sliding the support (i) of the suction means (b) within the housing, (d) restriction means providing passage for said suction means (b) but not the stamp so that the stamp is released from the suction means (b), and (e) a chute for receiving the stamp upon release thereof from the suction means (b).

2. The apparatus of claim 1 including, additionally, means for preventing actuation of the coin actuating means (c) upon insertion of a coin in the apparatus when stamps in the magazine (a) are exhausted.

3. The apparatus of claim 2 wherein the means for preventing actuation of the coin actuating means (c) includes arm means and flap means for preventing actuation of the suction means (b) whereby said arm means coacts with the magazine (a) and releases said flap means thereby blocking the coin actuated means (c).

4. The apparatus of claim 1 wherein the magazine (a) includes, more particularly, (i) means for urging the stamps toward the suction means (b), (ii) pawl and cog means providing unidirectional movement of stamps in the magazine toward the suction means (b), and (iii) yieldable retention means for retaining the stamps in the magazine (a) but yieldable so as to release a stamp therefrom upon attachment of the suction means (b) to said stamp.

5. The apparatus of claim 1 wherein the restriction means (d) for releasing the stamp from the suction means (b) comprises a wall within the housing having a portal through which the tube (b) (ii) passes such that upon contact with the wall by a stamp in suction engagement with the tube, the stamp is released from said tube.

6. The apparatus of claim 1 wherein in the suction means (b) the means (b) (iii) urging the tube (b) (ii) away from the support (b) (i) includes, (1) a plunger for sliding engagement within the tube (b) (ii), and (2) a spring biasing the plunger from said tube and against the support (b) (i).

7. The apparatus of claim 1 wherein in the suction means (b) the means (b) (iii) urging the tube (b) (ii) away from the support (b) (i) includes a bellows mounted at one end of the tube (b) (ii) and secured to the support (b) (i).

8. Apparatus for dispensing stamps, having a housing including therein, (a) a magazine for containing and positioning at least one row of a stack of stamps, said magazine comprising more particularly (i) means for urging the stamps toward the suction means (b), (ii) pawl and cog means providing unidirectional movement of stamps in said magazine toward the suction means (b) herein, and (iii) yieldable retention means for retaining stamps in the magazine but yieldable so as to release a stamp therefrom upon attachment of the suction means (b) herein to said stamp, (b) suction means for releasably attaching to a stamp and withdrawing said stamp from the magazine (a), said means comprising, (i) a support slideable within the housing, (ii) a tube slideably retained within the support (i), and (iii) means urging the tube (ii) away from the support (i) whereby said tube engages by suction a stamp within the magazine (a), (c) coin actuated means for sliding the support (i) of the suction means (b) within the housing, (d) means for preventing actuation of the coin actuated means (c) upon insertion of a coin in the apparatus when the stamps in the magazine (a) are exhausted, (e) means for releasing a stamp from the suction means (b) comprising a wall within the housing having a portal through which the tube (ii) of the suction means (b) passes such that upon contact with the wall by a stamp in suction engagement with said tube, the stamp is released from the tube, and (f) a chute for gravitationally receiving a stamp upon release thereof from the suction means (b).

9. The apparatus of claim 8 wherein the means (d) for preventing actuation of the actuating means (c) includes arm means and flap means for preventing actuation of the suction means (b) whereby said arm means coacts with the magazine (a) and releases said flap means thereby blocking the actuating means (c).

10. The apparatus of claim 8 wherein the suction means (b) includes a plurality of tubes (ii) and means (iii) urging said tubes from the support (b) (i) whereby said tubes engage by suction stamps within the magazine (a).

* * * * *